United States Patent [19]

Neilsen

[11] 4,089,204

[45] May 16, 1978

[54] DEBURRING APPARATUS

[76] Inventor: Hildaur L. Neilsen, 2 Juniper St., Metuchen, N.J. 08840

[21] Appl. No.: 812,988

[22] Filed: Jul. 5, 1977

[51] Int. Cl.[2] ..... B21J 7/02

[52] U.S. Cl. ..... 72/412; 72/452; 72/465; 72/470; 173/123

[58] Field of Search ..... 72/407, 412, 453, 470, 72/435, 429, 465; 173/123

[56] References Cited

U.S. PATENT DOCUMENTS

| | | | |
|---|---|---|---|
| 1,677,968 | 7/1928 | Hughes | 72/412 |
| 2,373,901 | 4/1945 | Lowery | 72/335 |
| 3,412,594 | 11/1968 | Lund | 72/452 |
| 3,494,168 | 2/1970 | Williamson | 72/335 |
| 3,707,087 | 12/1972 | Neilson | 72/429 |
| 3,866,452 | 2/1975 | Neilson | 72/199 |
| 3,926,031 | 12/1975 | Neilson | 72/407 |

*Primary Examiner*—C. W. Lanham

*Assistant Examiner*—Gene P. Crosby

*Attorney, Agent, or Firm*—Robert Henderson

[57] ABSTRACT

A generally cylindrical, vertically vibrating peening tool has an integral, small diameter, cylindrical pilot at its lower end, adjoining a larger upper body portion of said tool at an annular juncture area having an outwardly concave surface at all circumferential points therearound. Supported below said peening tool is a resiliently yieldable anvil having a cylindrical top opening receptive of said pilot with a close sliding fit. The top of the anvil is flat and supports a workpiece between the tool and the anvil with a hole in the workpiece aligned with said pilot, enabling the latter to extend through said hole and into the anvil's said top opening. The workpiece is shiftable horizontally upon the anvil to enable all portions of the upper edge of said hole to be brought into peening, deburring engagement with said concave juncture area of the peening tool.

5 Claims, 4 Drawing Figures

DEBURRING APPARATUS

BACKGROUND AND OBJECTS OF THE INVENTION

The broad principle of vibrating a peening tool against a metal edge or edges to be deburred has quite recently been developed and has been proven to be very effective. Successful deburring devices employing that principle are shown, for example, in my U.S. Pat. Nos. 3,707,087; 3,866,452; and 3,926,031; and in my pending application, Ser. No. 723,489, now U.S. Pat. No. 4,041,751.

While the devices disclosed in said patents and application are effective for deburring outside edges of a workpiece, those devices or tool assemblies thereof are of such sizable dimensions as to prohibit their practical use in deburring edges of relatively small holes formed in sheet metal.

The principal object of the present invention is to provide effective means for deburring edges of such relatively small holes. This objective is achieved by devices as disclosed and described herein.

DETAILED DESCRIPTION

The Principle Components of the Apparatus

The principle components are an anvil A for supporting a workpiece X of sheet metal or the like; an anvil-supporting assembly B for mounting the anvil upon a machine tool table Y and providing vertically adjustable support for the anvil; an edge-peening tool C; and a tool hammering assembly D by which said tool is carried; the latter assembly including a portion coacting with a machine tool portion such as, for example, a chuck Z of a drill press, by positioning adjustment of which the tool C may be brought into cooperating vertical alignment with the underlying anvil.

The Anvil and Its Supporting Assembly

The anvil A comprises a generally cylindrical body portion 10, formed with a central, lower bore 12 of relatively large diameter, opening at the bottom of said body portion, and a central, relatively small diameter counterbore 14 opening at the top of said anvil; the top surface 16 of which preferably is flat to adapt it to support a workpiece X upon it in a horizontal position.

Figure 1:
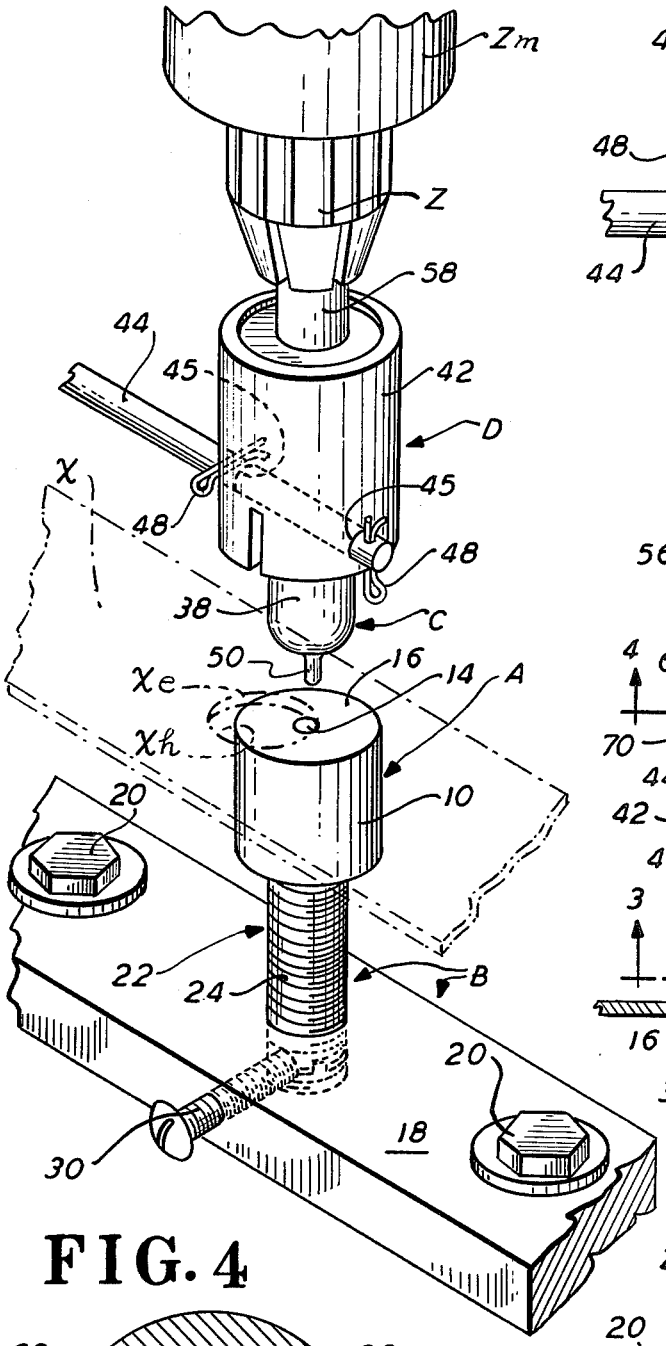
FIG. 1 is a perspective view of apparatus according to a preferred embodiment of this invention.
Figure 3:
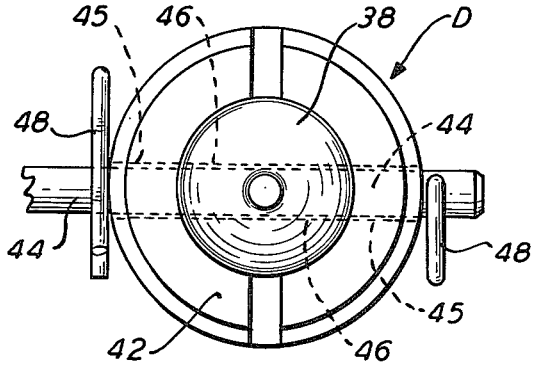
FIG. 3 is a cross sectional view of said apparatus, substantially on the line 3—3 of FIG. 2.
Figure 2:
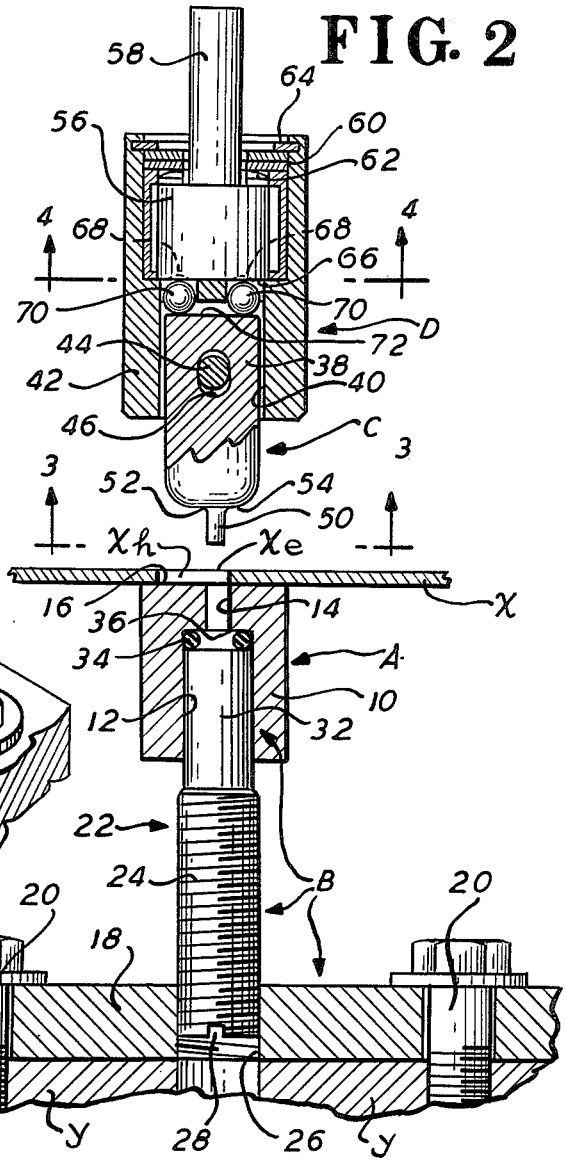
FIG. 2 is a largely central, vertical, sectional view of the apparatus shown in FIG. 1.
Figure 4:
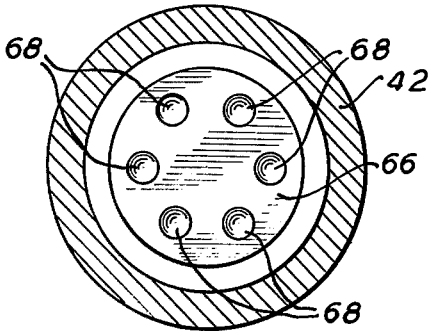
FIG. 4 is a cross sectional view of said apparatus, substantially on the line 4—4 of FIG. 2.

The anvil supporting assembly B comprises a base plate 18 with suitable means as, for example, bolts 20 for fastening said base plate firmly upon a machine tool table Y. A sturdy, anvil supporting stem 22 is provided with a threaded lower end portion 24 which is adjustably threaded into a hole 26 in the base plate 18. The lower end of the stem 22 is formed with a screw driver slot 28, enabling the user to adjust the height of said stem by threading it upwardly or downwardly. A set screw 30 (FIG. 1) is threaded laterally into the base plate 18 at one side thereof, to forcefully engage and lock the stem 22 in any adjusted position.

An upper end portion 32 of the stem 22 is non-threaded and extends with a relatively accurate but free-sliding fit within the lower bore 12 of the anvil A; and the latter is resiliently supported by a rubber "O" ring or equivalent resilient support means. Said "O" ring is disposed in the bore 12, between the upper end of the stem 22 and a shoulder 36 at the juncture of the bores 12 and 14. Said resilient support means enables the anvil A to vibrate during operation of the apparatus as hereinafter explained.

The Edge Peening Tool

The tool C is generally cylindrical and solid, and is formed with an upper or body portion 38 of such diameter as to enable it to accurately but freely-slidably fit within a cylindrical opening 40 in the bottom of a housing 42 of the hammering assembly D. The tool C is retained within the opening 40, for limited vertical reciprocation therein, by a steadying rod 44 which extends laterally and centrally through circular holes 45 in the wall of the housing 42 with a close fit and slidably through a transverse oval bore 46 formed in the body portion 38 of the peening tool C. the steadying rod 44 is held in its just described disposition by cotter pins 48 which extend through said rod at opposite sides of the housing 42 of the hammering assembly D.

The lower end of the body portion 38 of the peening tool C merges rigidly and integrally with a solid, vertically extending nipple 50 which serves as a pilot of such length as to enable it to protrude downwardly through a hole XH in the workpiece X and further downwardly with at least a small bottom portion of said nipple protruding into the upper bore 14 of the anvil A.

The upper edge XE of the hole XH is the edge to be deburred, and the portion of the peening tool C which peens and deburrs that edge is an annular, outwardly concave juncture 52 of the nipple 50 and a flat, annular, bottom surface 54 of said tool's body portion 38.

The Tool Hammering Assembly

The disclosed tool hammering assembly D is about the same as a corresponding assembly disclosed in my U.S. Pat. No. 3,926,031 to which reference may be had if needed for an understanding of said assembly in the present invention. However, for completeness of the present disclosure, the essential features of said assembly in the present invention are set forth herein.

The hammering assembly D comprises a rotary hammer 56 having an integral, upper shank 58 clamped in, for example, the chuck Z of a motor ZM by means of which the hammer 56 is continuously rotated. The hammer 56 is suitably supported in the housing 42 and retained therein by flat washers 60, a wavy-spring washer 62, and a snap ring 64. The bottom face 66 of the hammer 56 is flat and is formed with a circular, concentric, continuous series of frusto-spherical, equidistantly spaced indentations 68, which coact with steel balls 70, suitably retained in the housing 42 between the hammer 56 and a top flat surface 72 of the tool C. The just mentioned coaction is such that, during rotation of said tool, said balls are caused by the indentations 68 to rapidly rise and fall and, consequently, cause said tool to rise and fall within the limits of the greater, vertical diameter of the oval bore 46 in said tool.

THE DEBURRING OPERATION

Although possibly useful with other machine tools, the apparatus of this invention is disclosed and described herein as used in association with a drill press.

A workpiece X is suitably held intimately down upon the flat top surface 16 of the anvil A with the workpiece's hole XH aligned with the anvil's upper bore 14, and with the edge XE, to be deburred, facing upwardly. Then, or previously, the tool hammering assembly D is adjusted horizontally to bring the nipple 50 of the tool C into vertical alignment with the bore 14 of the anvil.

The vertical adjusting means (not shown) of the related drill press is then operated to so lower the parts C and D of the deburring apparatus that the pilot 50 protrudes through the underyling aligned hole XH of the workpiece X and at least partially into the bore 14 of the anvil A. During this lowering operation, the workpiece X is held so that a side surface defining the hole XH engages a side surface of the pilot 50, and that the upper surface of the workpiece, adjacent to said hole, is engaged by the annular bottom surface 54 of the tool C.

As operation of the motor ZM to turn the hammer 56 undesirably tends to turn the housing 42, the steadying rod 44 should be held against turning about said hammer's axis of rotation. A need for manual holding of said rod is preferably avoided by securing the rod's free end with a stout elastic band, a cord, or clamp, or the like (not shown) to some adjacent fixed part of the drill press or other utilized machine tool.

With the hammer 56 being rotated rapidly by the motor ZM and the housing 42 suitably held against turning, the workpiece X is shifted horizontally to cause all parts of the edge XE to progressively move around the pilot 50 in forceful peening engagement with the outwardly concave annular juncture 52 of the tool C. Such peening serves to deburr the edge XE.

Noting that the hammer 56, through coaction with the balls 70, serves to rapidly reciprocate or vibrate the tool C to yield the described peening and deburring effect, it should be noted that the vibration of said tool is accentuated by the wavy spring washer 62. Also worthy of note, is the fact that while the anvil A serves to support a workpiece, it functions additionally in that the vibratory force which it receives from the hammer 56 is accentuated due to the resilient support given to the anvil by the "O" ring 34. This two fold accentuation of the peening action enhances the efficiency of the disclosed deburring apparatus.

Although the present invention has been described as for deburring a circular hole, it may be employed to deburr an edge of a hole of irregular shape. Also, although primarily developed for deburring edges of holes, it may also be used to deburr an outer edge of a workpiece.

Excepting the "O" ring 34 or other equivalent resilient means, the various parts of the disclosed apparatus are preferably of steel of suitable characteristics for the particular functions to be performed.

It will be understood by those familiar with the subject art, that this invention may be practiced in various other ways without, however, departing from the invention as set forth in the accompanying claims.

I claim:

1. Deburring apparatus comprising a generally cylindrical peening tool formed with a cylindrical body portion and an adjoining, coaxial, rigidly-integral, cylindrical, pilot of reduced diameter extending downwardly from said body portion, the juncture of said body portion and pilot being formed to provide an annular outwardly-concave juncture surface; a hammering assembly coacting with said tool to impose intermittent, downwardly directed, hammering force upon said tool; separate anvil means disposed below said tool and formed with an upwardly opening bore therein of such diameter as to admit said pilot thereinto with an accurate sliding fit; and said assembly and tool on the one hand and said anvil means on the other hand being movable approximately vertically relatively to each other to bring said juncture surface into peening engagement with an adjacent edge of a related workpiece and to project a lower portion of said pilot into said bore.

2. Deburring apparatus according to claim 1, said anvil means comprising a cylindrical anvil element formed with a downwardly opening bore therein; an approximately vertical supporting stem having an upper end portion projecting into the latter bore with an accurate, freely sliding fit; and resilient means disposed between said stem and an overlying shoulder of the latter bore to resiliently support said anvil element upon said stem.

3. Deburring apparatus according to claim 2, said supporting stem being vertically adjustable.

4. Deburring apparatus according to claim 2, said resilient means being an "O" ring of resilient material.

5. Deburring apparatus according to claim 4, said hammering assembly including a cylindrical housing, a rotary hammer disposed in said housing constrained to reciprocate vertically during rotation thereof and coacting with said tool to impose said downwardly directed hammering force thereupon; and an annular wavy spring coacting between said housing and said hammer to contribute to said reciprocation of the hammer; said "O" ring and said wavy spring coacting to enhance the peening effect of said tool upon said edge of a related workpiece.

* * * * *